United States Patent [19]

Hrytzak

[11] 4,299,340

[45] Nov. 10, 1981

[54] PAINT CAN ATTACHMENT

[76] Inventor: Bernard J. Hrytzak, P.O. Box 382, Chatham, Ontario, Canada, N7M 5K5

[21] Appl. No.: 118,143

[22] Filed: Feb. 4, 1980

[51] Int. Cl.[3] ..... B67D 5/58; B65D 25/48

[52] U.S. Cl. ..... 222/189; 222/570; 220/90; 220/85 SP

[58] Field of Search ..... 222/565-567, 222/569-571; 220/85 SP, 90

[56] References Cited

U.S. PATENT DOCUMENTS

| | | | |
|---|---|---|---|
| 1,959,584 | 5/1934 | Hurley | 222/570 |
| 2,420,487 | 5/1947 | Long | 220/90 |
| 2,817,465 | 12/1957 | Gray | 222/570 |
| 2,983,938 | 5/1961 | Veazey | 220/90 |
| 3,168,962 | 2/1965 | Rawlins et al. | 220/90 |
| 3,239,113 | 3/1966 | Knize | 222/569 |
| 4,125,210 | 11/1978 | Embree | 222/570 |

FOREIGN PATENT DOCUMENTS

| | | | |
|---|---|---|---|
| 1043743 | 12/1978 | Canada | 222/570 |

*Primary Examiner*—H. Grant Skaggs
*Attorney, Agent, or Firm*—Rogers, Bereskin & Parr

[57] ABSTRACT

An attachment for paint cans and the like is disclosed. The attachment includes a trough shaped pouring spout which is fitted to the rim of a can by a channel section member which snaps over the rim. The spout has a curved knife edge at its outer end and slopes upwardly away from the can so that, at the end of a pouring operation, the edge will cleanly cut off the flow of paint and residual paint will flow back into the can. The curved knife edge allows the attachment to also be used for scraping paint from a roller.

8 Claims, 19 Drawing Figures

FIG. 4
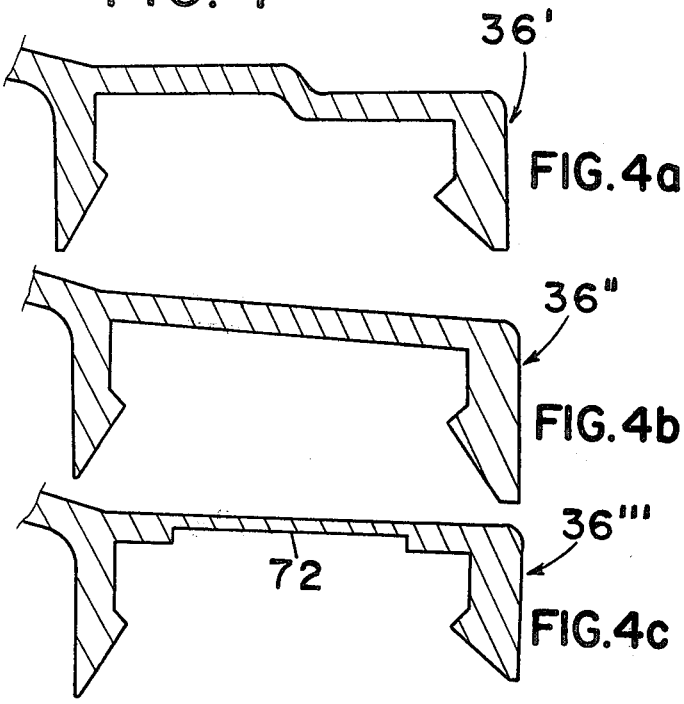
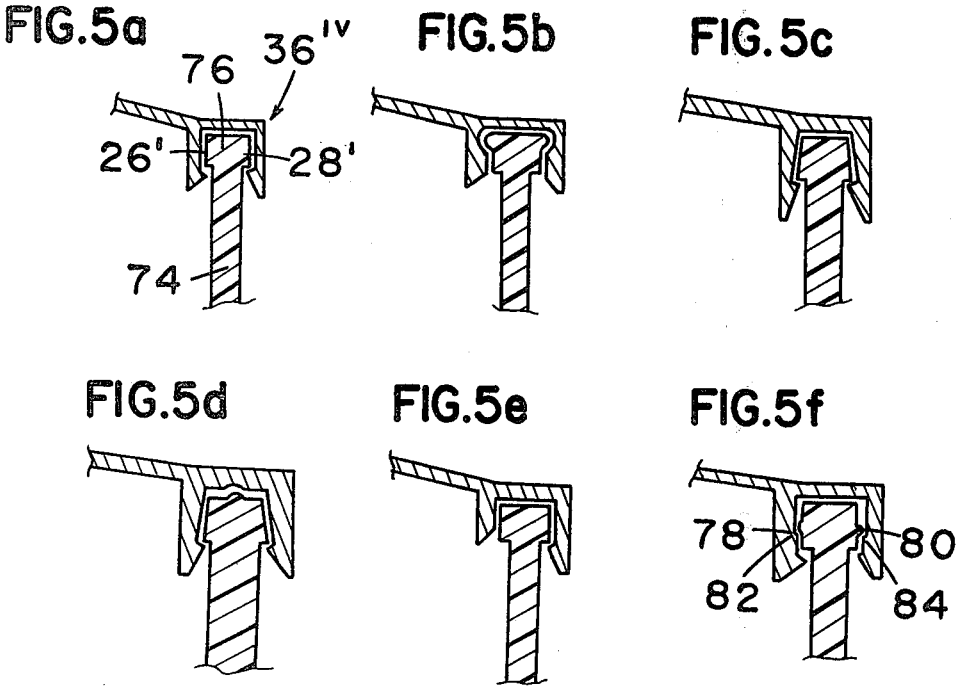

PAINT CAN ATTACHMENT

This invention relates to an attachment for paint cans and the like, which is designed to serve primarily as a pouring spout but which also has a number of other functions.

The United States Patent Literature contains numerous examples of attachments of this type. Amongst these are the following United States patents which were considered during the preparation of the present application:

U.S. Pat. No. 2,071,638 Lauterbach;
U.S. Pat. No. 2,469,864 Craft et al;
U.S. Pat. No. 2,471,189 Bartels;
U.S. Pat. No. 2,657,838 Kramer et al;
U.S. Pat. No. 2,767,891 Beadles;
U.S. Pat. No. 3,074,604 Baroud;
U.S. Pat. No. 3,159,321 Severino;
U.S. Pat. No. 3,899,107 Gaal;
U.S. Pat. No. 4,009,802 Hayduchok.

An object of the present invention is to provide an improved attachment for a paint can and the like.

The attachment provided by the invention is intended for use with a can of the type which includes a cylindrical side wall having at an upper end thereof, at least an inner peripheral bead which surrounds a circular opening at the top of the can. The attachment is in the form of a one piece plastic moulding and includes a trough shaped pouring spout defined by a base portion of a shape which tapers from an inner end to an outer end and which has convergent rectilinear side edges, and edge portions which extend along such side edges of the base portion and which project upwardly therefrom to form said trough shape. The base portion curves laterally upwardly at least adjacent said outer end from a central area of the base portion towards both of said edge portions and includes a curved knife edge at said outer end, defined by the upper surface of the base portion and an undercut surface portion which extends downwardly and inwardly of the base portion of the surface. A channel section member depends from the spout base portion at the inner end thereof and is longitudinally curved to conform with the curvature of the cylindrical side wall of the can. The inner end of the spout base portion is curved in conformity with the channel section member and defines therewith an inner lip over which paint can flow from the can on to the spout when the can is tipped. The channel section member defines opposite limbs, at least an inner one of which has an inwardly directed rib arranged to engage below said inner peripheral bead on the can. The base portion is inclined with respect to the channel section member so that at least an outer portion of its upper surface slopes upwardly when the attachment is fitted to a can, whereby paint will tend to run back into the can.

In order that the invention may be more clearly understood, reference will now be made to the accompanying drawings which illustrate a number of preferred embodiments of the invention by way of example. In the drawings.

Figure 1:
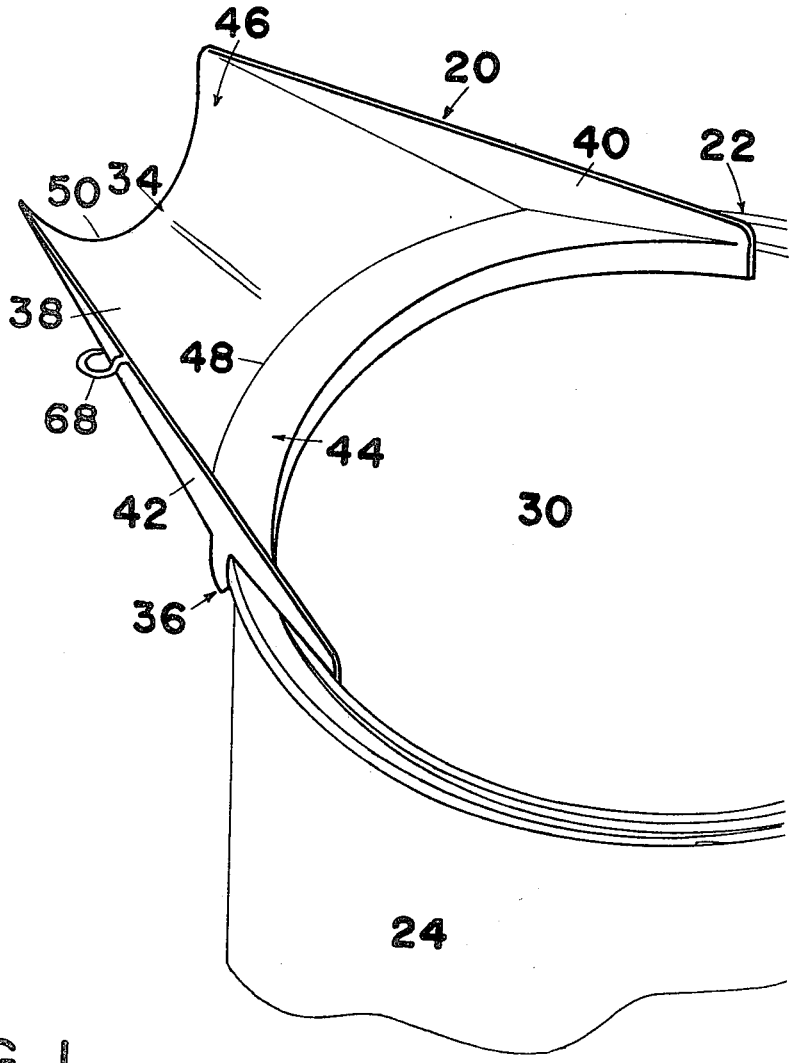
FIG. 1 is a perspective view showing a conventional paint can with the attachment fitted thereto.
Figure 2:
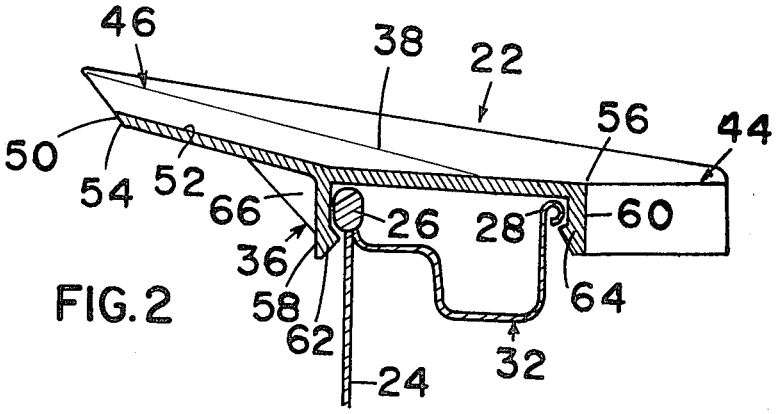
FIG. 2 is a longitudinal sectional view through the attachment of FIG. 2.
Figure 3A:
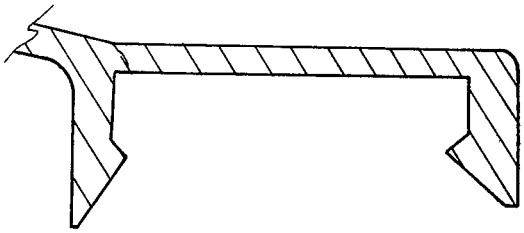
Figure 3B:
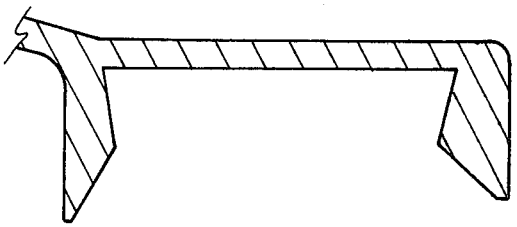
Figure 3C:
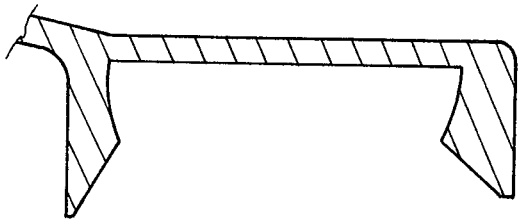
Figure 3D:
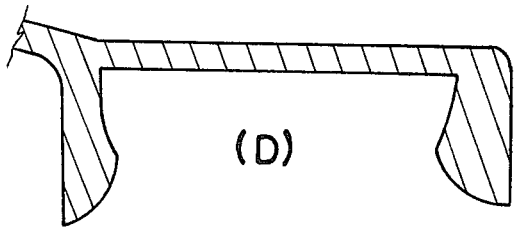
Figure 6:
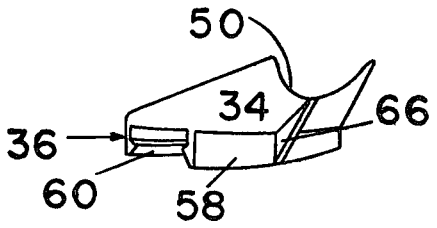
Figure 7:
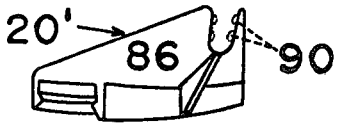
Figure 8:
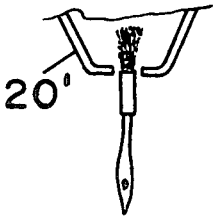
Figure 9:
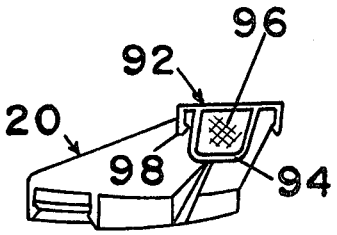

FIGS. 3(*a*), 3(*b*), 3(*c*), and 3(*d*) are four different sectional views through the channel section member of the attachment and show alternative configurations for this member;

FIGS. 4(*a*), 4(*b*) and 4(*c*) are sectional views through the channel section member of the attachment and show further alternative configurations of this member;

FIGS. 5(*a*), 5(*b*), 5(*c*), 5(*d*), 5(*e*) and 5(*f*) show further forms of the channel section member suitable for use with plastic moulded paint containers;

FIG. 6 is a perspective view from the outer end of the attachment shown in FIGS. 1 and 2;

FIG. 7 is a view similar to FIG. 6 showing a further modification of the invention;

FIG. 8 is a somewhat diagrammatic plan view showing the attachment of FIG. 7 in use; and FIG. 9 is a view similar to FIGS. 6 and 7 and illustrates a further form of attachment.

Referring first to FIGS. 1 and 2, the attachment provided by the invention is generally indicated at 20 in association with a paint can 22. Can 22 is essentially of conventional form and includes a cylindrical side wall 24 having at an upper end thereof, inner and outer peripheral beads 26 and 28 (FIG. 2) which surround the circular opening 30 (FIG. 1) at the top of the can. In this embodiment, the can is of conventional form and the beads 26 and 28 are formed at opposite sides of a channel section rim 32 which extends around the top of the side wall of the can and into which the lid of the can (not shown) can be fitted. Within the broad scope of the invention, the attachment can be fitted to other forms of can as will be more specifically described later.

Attachment 20 is a one piece plastic moulding and includes a trough shaped pouring spout 34 and a channel section member 36 by which the spout is fitted to the can. Spout 34 is defined by a base portion 38 and side edge portions 40 and 42 which project upwardly from the base portion to form the trough shape of the spout. The base portion itself is of a shape which tapers from an inner end 44 to an outer end 46 and which has convergent side edges. In other words, the base portion is generally of truncated triangular shape as viewed in plan.

In FIG. 1, the channel section member 36 is of a width which extends approximately to the position of the arcuate line indicated at 48. Outwardly of that line, the base portion curves laterally upwardly from a central area towards both of the edge portions 40 and 42 and includes a curved knife edge 50 at its outer end. As can best be seen in FIG. 2, the knife edge 50 is defined by the upper surface of base portion 38 (denoted 52) and an undercut surface portion 54 which extends downwardly and inwardly of the base portion of the surface.

Channel section member 36 is disposed at the inner end of the spout based portion 38 and is longitudinally curved to conform with the curvature of the cylindrical side wall of the can. The inner end of base portion 38 is also curved in conformity with the curvature of the channel section member and defines therewith an inner lip 56 (FIG. 2) over which paint can flow from the can on to the spout when the can is tipped. With continued reference to FIG. 2, it will be seen that the channel section member 36 has opposed limbs 58 and 60 having inwardly directed ribs 62 and 64 which are arranged to snap fit over the respective beads (26 and 28) on the can.

The spout base portion 38 is inclined with respect to the channel section member 36 as can best be seen in FIG. 2, so that at least an outer portion of the upper surface of the base portion slopes upwardly away from the can when the attachment is in place so that paint will tend to run back into the can when the can is returned to its normal upright position after pouring. FIG. 2 also shows a strengthening gusset 66 which extends between part of the base portion 38 and the outer limb 58 of member 36. It will also be seen from this view that spout base portion 38 defines the back wall base of the channel section member 36.

Referring back to FIG. 1, a hook indicated at 68 is integrally moulded with one side of the attachment so that the attachment can be readily hung from a support, e.g. in a store or workshop.

It will be appreciated from the description so far that the attachment provided by the invention has a number of functions in association with the paint can and can be readily fitted to and removed from the can. Its primary function is to permit paint to be easily poured from the can. The knife edge 50 described above has been found to be particularly useful in this connection, in that, it serves to cut off the flow of paint cleanly when the can is returned to its upright position at the end of a pouring operation. At the same time, the sloping outer portion of the spout ensures that any paint remaining in the spout will run back into the can. Edge 50 is curved as can best be seen from FIGS. 1 and 6. In this particular embodiment, the curvature of edge 50 is selected to approximate the typical surface curvature of a paint roller so that attachment 20 can also be used for scraping paint from such a roller. For example, with the attachment in place on the can, a roller can be drawn downwardly and outwardly over edge 50 so that residual paint will be removed from the roller and flow back into the can. Alternatively, the attachment can be removed from the can and drawn along the roller with edge 50 in contact with the roller surface in a scraping action.

The inner lip 44 of the attachment can also be used as a brush wiper by drawing a brush upwardly and outwardly over lip 44, paint is effectively squeezed out of the bristles and will run back into the can.

Another function of the attachment is as a brush rest. Thus, a brush can be positioned with its bristles on base portion 38 and with its handle supported on the rim of the can at the position generally diametrically opposite to the position of attachment 20.

It will be appreciated that an important feature of the attachment is that it can be readily snap fitted on to and removed from a can. In FIG. 2, the ribs 62 and 64 at the inner sides of the limbs of channel member 36 are of generally triangular shape and are arranged adjacent the lower ends of the limbs. Limb 60 is somewhat shorter than limb 58 so that its rib 64 is closer to the base of the channel member than rib 62. This is because of the particular shaping and arranging of the beads 26 and 28 on the paint can. FIG. 3 illustrates a number of other possible configurations for these ribs according to the particular cans with which the attachment is to be used. In these cases, the side limbs of the channel section member are disposed generally normal to the base of the member. FIG. 4(*a*) and 4(*b*) illustrate modifications which may be made to position the ribs at different levels. In FIG. 4(*a*), an offset portion denoted 70 is provided in the base of the channels section member (denoted 36'), while in FIG. 4(*b*) the base of the channel section member, (denoted 36'') is inclined with respect to both limbs of the member.

In some cases, it may be necessary to provide for vertical flexibility between the respective limbs of the channels section members, for example, to accommodate cans with different bead configurations and/or to allow the attachment to be used on a range of different cans. In this embodiment, the base of the channel section member (denoted 36''') is provided with a longitudinal channel shaped recess 72 which imparts the required flexibility to the member.

FIG. 5 illustrates a number of alternative forms of channel section member which may be employed where the attachment is to be used with moulded plastic paint containers. For example, in FIG. 5(*a*), part of the wall of such a container is indicated at 74 and has a moulded thickened portion 76 at its upper end which defines laterally projecting portions defining inner and outer beads 28' and 26' respectively. In that case, the channel section member, denoted $36^4$ is substantially narrower than the channel section members shown in the previous embodiments and is shaped to closely receive the formation 76. FIGS. 5(*b*) to (*f*) show other possible configurations for the channel section member to cater for different forms of container. In FIG. 5(*f*) narrow ribs 78 and 80 project laterally from the beads on the can and engage corresponding ledges, denoted 82 and 84 inside the channel section member.

FIG. 6 is a perspective view of the attachment as shown in FIGS. 1 and 2 and shows clearly the curved knife edge 50 at the outward end of the attachment. In FIG. 7 edge 50 has been replaced by a curved knife edge, denoted 86, which is generally U-shaped and which is dimensioned so that a paint brush, such as that indicated at 88 in FIG. 8, can be drawn through the space defined by the edge for squeezing paint from the brush but easy for cleaning. In FIGS. 7 and 8, the attachment itself is denoted 20'. Reference number 90 in FIG. 7 denotes inwardly directly projections which may be provided along edge 86 as a further feature of the invention designed to aid brush cleaning.

FIG. 9 shows the attachment 20 of FIGS. 1 and 2 fitted with a paint strainer denoted 92. Strainer 92 comprises a moulded plastic frame 94 which supports a mesh 96 arranged to fit over the space defined by the curved edge 50 of the attachment. Hook shaped projections 98 at the sides of frame 94 engage over the sides of the spout of the attachment for retaining the paint strainer in place. Suitable integral moulded formations may be provided on the attachment for engagement with these projections.

It will of course be appreciated that the preceding description relates to specific embodiments of the invention and that many modifications are possible within the broad scope of the invention. For example, in the embodiment shown in FIG. 2, the inner peripheral bead 28 could be curled inwardly and limb 60 extended downwardly to engage below the bottom of rim 32. It should also be noted that, while the description relates specifically to an attachment for a paint can, there is no limitation in this regard. The attachment may be used with other forms of liquid container.

Finally, it is to be understood that the term "bead" as used in relation to the container includes any form of lateral projection from the container wall below which the attachment can engage: for example, in the modified version of the FIG. 2 embodiment discussed in the preceding paragraph, the rim 32 would itself be considered as the bead. In the minimum case, a bead need be provided at the inner periphery of the container opening only.

I claim:

1. An attachment for a paint can and the like of the type which includes a cylindrical side wall having at an upper end thereof, at least an inner peripheral bead which surrounds a circular opening at the top of the can, the attachment being in the form of a one piece plastic moulding comprising:

a trough shaped pouring spout defined by a base portion of a shape which tapers from an inner end to an outer end and which has convergent side edges, and edge portions which extend along said side edges of the base portion and which project upwardly therefrom to form said trough shape, said base portion curving laterally upwardly at least adjacent said outer end from a central area of the base portion towards both of said edge portions and including a curved knife edge at said outer end, defined by the upper surface of said base portion and an undercut surface portion which extends downwardly and inwardly of said base portion upper surface;

a channel section member which depends from said spout base portion at said inner end thereof and which is of an arcuate shape having a curvature conforming to the curvature of said cylindrical side wall of the can and a length corresponding to the width of said spout at its said inner end, terminating even with said side edge portions of the spout, said inner end of the spout base portion being curved in conformity with said channel section member and defining therewith an inner lip over which paint can flow from the can onto said spout when the can is tipped, said side edge portions of the spout extending to the inner end of said spout and terminating at least at opposite ends of said lip so that paint is laterally constrained by said side edge portions immediately as it begins to flow over said lip, said channel section member defining opposite limbs at least an inner one of which has an inwardly directed rib arranged to engage below said inner peripheral bead on the can; said base portion being inclined with respect to said channel section member so that at least an outer portion of its upper surface slopes upwardly when the attachment is fitted to a can, whereby paint will tend to run back into the can.

2. An attachment as claimed in claim 1, wherein said curved knife edge is of an arcuate shape selected to permit the attachment to be used for scraping paint from a paint roller.

3. An attachment as claimed in claim 1, wherein said curved knife edge is generally U-shaped so that a paint brush can be drawn through the opening defined by said edge and across the edge for squeezing of paint from the bristles of the brush.

4. An attachment as claimed in claim 3, further comprising projections extending inwardly of said curved knife edge for further facilitating removal of paint from a brush.

5. An attachment as claimed in claim 1, wherein each of said channel section member limbs is provided with one of said inwardly directed ribs, and wherein the ribs are shape to snap fit below both of said inner and outer peripheral beads on a can.

6. An attachment as claimed in claim 5, wherein the portion of said channel section member intermediate said limbs is formed with a longitudinally extending recess designed to impart vertical flexibility to said limbs for facilitating engagement of the limbs with a can having inner and outer peripheral beads at different heights.

7. An attachment as claimed in claim 1, further comprising a paint strainer including a mesh, the strainer being adapted to be fitted to said spout of the attachment so that the mesh is disposed over said curved knife edge of the spout whereby paint poured through the spout passes through the mesh.

8. An attachment as claimed in claim 1 for a paint can and the like having an outer peripheral bead surrounding said circular opening and spaced outwardly from said inner peripheral bead, wherein said channel section member has inner and outer limbs, both of which have inwardly directed ribs arranged to snap fit below said peripheral beads of the paint can and the like.

* * * * *